United States Patent [19]

Daly

[11] 4,266,678

[45] May 12, 1981

[54] NESTING UNITS

[75] Inventor: Geoffrey J. Daly, East Killara, Australia

[73] Assignee: Brambles Holdings Limited

[21] Appl. No.: 72,858

[22] Filed: Sep. 5, 1979

Related U.S. Application Data

[63] Continuation of Ser. No. 884,876, Mar. 9, 1978, abandoned.

[30] Foreign Application Priority Data

Mar. 21, 1977 [AU] Australia ..... PC9493

[51] Int. Cl.[3] ..... A47B 47/00; B65D 19/38

[52] U.S. Cl. ..... 211/194; 108/53.3; 108/53.5

[58] Field of Search ..... 108/53.1, 53.3, 53.5; 211/194, 188; 206/505, 507

[56] References Cited

U.S. PATENT DOCUMENTS

| | | | |
|---|---|---|---|
| 3,762,343 | 10/1973 | Thacker | 108/53.3 |
| 3,945,501 | 3/1976 | Jay | 108/53.5 X |

*Primary Examiner*—William E. Lyddane

*Attorney, Agent, or Firm*—Ladas & Parry

[57] ABSTRACT

This invention relates to nestable racking units which when arranged in an operating mode provide a racking system for goods or pallet loads and when arranged in a storage mode provide an easily transported nested group of such units.

2 Claims, 2 Drawing Figures

NESTING UNITS

This application is a continuation of application Ser. No. 884,876 filed Mar. 9, 1978, now abandoned.

The present invention provides several advantages over the known racking units and therefore provides a more versatile and more practical racking unit.

With racking units as known hitherto the arrangement and positioning of the posts is such that the units cannot be vertically nested but only horizontally nested.

One disadvantage of the foregoing is that in a nesting operation for units arranged in the operating mode the top most would be raised slightly on the forks of a forklift truck, the truck would then reverse and lower the unit and then advance to insert the former top unit into the former second top unit. As can be seen there is substantial fork truck movement required and also accurate positioning is needed.

Another disadvantage is that the posts do not occur at the four extreme corners of the base. This is a disadvantage when stacking long cylindrical articles.

This invention provides a racking unit which ameliorates these disadvantages. In the racking unit of this invention the four posts are located at the extreme corners of a substantially rectangular plane base. Also, the arrangement and positioning of the posts is such as to permit the vertical interengagement of a racking unit of this invention with another identical racking unit or a conventional racking unit.

This invention relates to nestable racking units which when arranged in an operating mode provide a racking system for goods or pallet loads and when arranged in a storage mode provide an easily transported nested group of such units.

The above concept is not new but the present invention provides several advantages over the known racking units and therefore provides a more versatile and more practical racking unit.

Racking units as known hitherto comprise a rectangular base and from the two adjacent corners of the front side first posts extend upwardly vertically, opposite (but not aligned with the first posts) are second posts fixed to the opposite (back) side of the base, they are inset from the corners thereof by a short distance and are thus closer together than the first posts. The second posts are joined by a top rail. Two front-to-back rails connect corresponding first and second posts. The two front-to-back rails have a general triangular configuration (as by being made from angle steel that the apex uppermost) and the base has correspondingly shaped grooves in its underface which sit over the front-to-back rails when units are in the first or operating mode. The arrangement and positioning of the back posts and the front-to-back rails permits horizontal interengagement of one unit into another unit by passing the back of the unit (that with the closer spaced posts) into the front of another unit (that with the wider spaced posts). The arrangement is such that the units cannot be vertically nested but only horizontally nested. This form of unit is disclosed in Australian Pat. No. 466966.

One disadvantage of the foregoing is that in a nesting operation for units arranged in the operating mode the top most would be raised slightly on the forks of a forklift truck, the truck would then reverse and lower the unit and then advance to insert the former top unit into the former second top unit. The two units so nested would then be raised and the forklift truck would go through a similar sequence to engage those two with the former third top unit. As can be seen there is substantial fork truck movement required and also accurate positioning is needed to ensure nesting without knocking the stack to the ground, as would occur by trying to nest misaligned units.

Another disadvantage is that with an arrangement, as described above, the posts do not occur at the four extreme corners of the base. This is a disadvantage when stacking long cylindrical articles, for example gas cylinders, in a front-to-back stack. As the rear posts are closer together they hold the cylinders within a certain space but the other ends of the cylinders can spread apart due to the front posts being wider spaced than the rear posts. The disadvantage of such an arrangement is at once obvious, as additional layers of cylinders are stacked there will be a tendency for the layers to be inclined downwardly forwardly.

It is an object of this invention to ameliorate these disadvantages.

In one broad form this invention provides a racking unit comprising a substantially rectangular plane base, a first pair of posts, and a second pair of posts, wherein the arrangement and positioning of said posts permit the vertical interengagement of said racking unit with another vertical racking unit, said first pair of posts being attached one each to adjacent extreme corners of said base, said first pair of posts extending in a direction substantially perpendicular to the plane defined by said base, said second pair of posts being attached one each to the other two adjacent extreme corners of said base, said second pair of posts extending in a direction substantially parallel to said first pair of posts, the space between said second pair of posts being substantially equal to the space between said first pair of posts.

It is preferred that the first and second pairs of posts are connected by means of connecting members which are oriented so as to extend parallel to the sides of the base.

It is further preferred that the racking unit include lug and spigot means which are positioned to engage the posts of other racking units during the interengagement of the racking unit with other units.

The invention will now be described with reference to the accompanying drawings in which.

Figure 1:
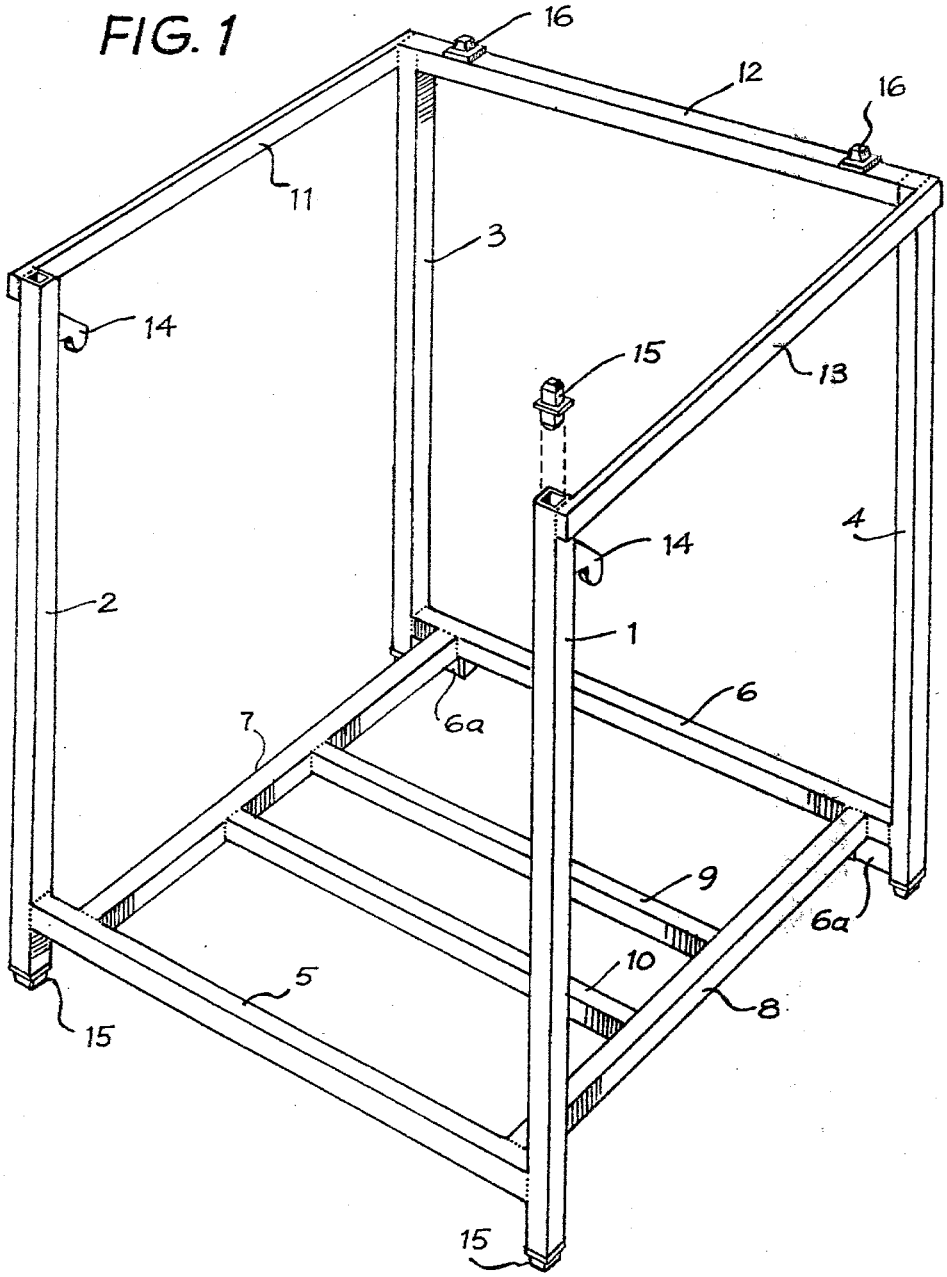
FIG. 1 is a schematic illustration of a preferred form of the invention.

Referring now to FIG. 1 there are four posts 1, 2, 3, 4, and a base consisting of front and back rails 5 and 6, tie bars 7 and 8 and lateral tie bars 9 and 10. The upper ends of the posts are joined by three connecting bars 11, 12 and 13.

Figure 2:
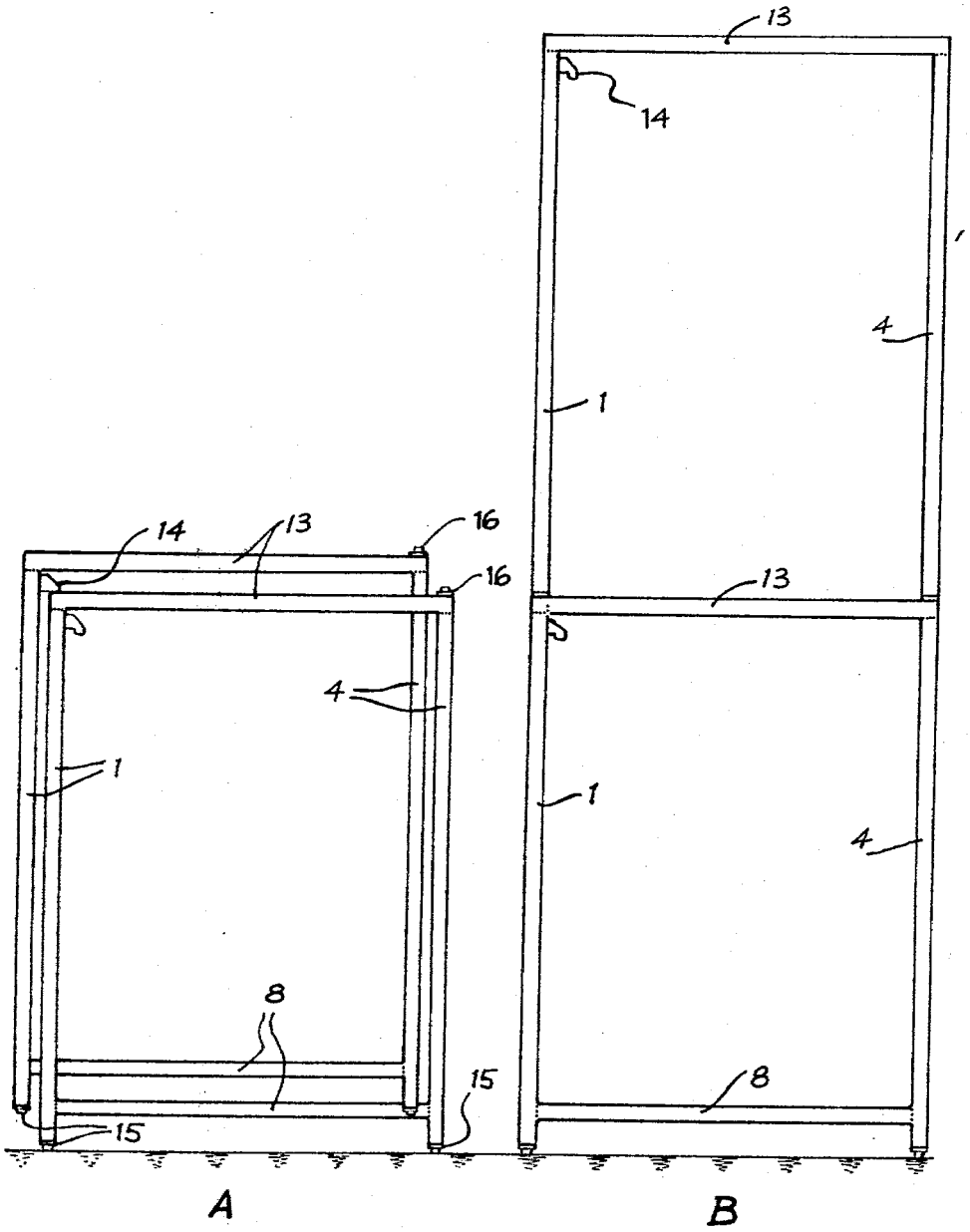
FIG. 2 is an illustration of a number of racking units in both the operational and storage configuration.

Referring now to FIG. 2 sketches 'A' and 'B' show respectively the storage configuration of two units and the stacked configuration of two units.

In the storage configuration the upper unit is held above the lower unit by the engagement of lug 14 in the open top of posts 1 and 2 and by engagement of sub-bar 6*a* with tie bars 7 and 8. In this way the forks of a forklift truck can be slid between the front rails 5 of the two units to engage under the rail 5 of the upper unit and the lateral tie bars 9 and 10 thereof.

The vertical nesting of two units is possible because of the location of the connecting bars 11 and 13 on the outer faces of posts 2-3, and 1-4. Horizontal nesting is prevented by the parallel relationship between posts 2-3, and 1-4.

The stacked configuration is as shown in sketch 'B' of FIG. 2. Spigots identified 15 fitted into the bottoms of the posts 1 to 4 have projecting ends which fit into the open top ends of the posts 1 to 4 of the lower unit. The spigots 15 of the lower unit rest upon the ground. Although not shown the open top end of posts 1 to 4 could be flared out to facilitate locating the spigots. From FIG. 1 it will be seen that locating dowels 16 are provided. These dowels are to enable a unit of this invention to stack with a unit as hereinbefore described as a known unit. Spigots 15 can be used to align the tops of the front posts of a unit of this invention with the bottoms of the posts of a known unit. The rear posts of the known unit being closer together than the front posts locate over the dowels 16. Thus the known unit can be located accurately on a unit of this invention.

In a reverse arrangement, new unit on known unit, the spigots 15 would be used to align the respective front posts and the top of the front-to-back rails of the known unit would locate under the sub-bar 6*a*.

The spigots 15 for the top and bottom of the posts may be as illustrated or modified if required to provide a projecting portion which is greater than the portion located within the posts, this latter (shorter) portion may be secured in the posts. Conveniently a modified spigot is fixed in the lower end of each post.

What I claim is:

1. A racking unit adapted for stacking engagement with an identical racking unit or with a particular non-identical racking unit, said racking unit comprising a substantially rectangular plane base, a first pair of posts, and a second pair of posts having respective mutually confronting faces, the arrangement and positioning of said posts permitting the vertical interengagement of said racking unit with another racking unit, said first pair of posts being attached one each of adjacent extreme corners of said base, said first pair of posts extending in a direction substantially perpendicular to the plane defined by said base, said second pair of posts being attached one each to the other two adjacent extreme corners of said base, said second pair of posts extending in a direction substantially parallel to said first pair of posts, the separation between said second pair of posts being substantially equal to the separation between said first pair of posts, first, second, and third connecting members each extending parallel to a side of said base, said first pair of posts being connected one each to a respective one each of said second pair of posts by means of said first and second connecting members and said second pair of posts being connected together by means of said third connecting member extending directly between the confronting faces of said second pair of posts, two lug members one each attached to respective posts of said first pair of posts, said lug members each including a first portion which has two ends and is secured at one end to a respective post of said first pair of posts and extends towards that post of said second pair of posts to which said post of said first pair of posts is connected by one of said first and second connecting members so that the other end of the lug member is spaced from that post of said first pair of posts to which said one end is secured, and a second portion which is secured to said other end of said first portion and extends towards said base, and spigot means fitted to the bottom of each post of said first and second sets of posts, said lug members being positioned to engage with their said second portions the open tops of the first pair of posts of another identical racking unit during the vertical nesting interengagement of said racking unit with said another racking unit, when said racking units are stored and said spigot means being adapted to engage the ends of corresponding posts of another identical racking unit when said racking unit and said identical racking unit are in a stacked configuration, and a pair of upwardly extending dowel means located on said third connecting member so as to engage the bottoms of the posts of a particular non-identical racking unit having a first pair of posts with separation identical to the separation between the first pair of posts of said racking unit and a second pair of posts with separation less than the separation between the second pair of posts of said racking unit, when said racking unit and said particular non-identical racking unit are stacked.

2. A racking unit as claimed in claim 1, wherein said racking unit includes a sub-bar means, said sub-bar means being adapted to engage the base of another racking unit during the vertical nesting interengagement of said racking unit with another racking unit.

* * * * *